US010655431B2

(12) United States Patent
Gonzalez et al.

(10) Patent No.: US 10,655,431 B2
(45) Date of Patent: May 19, 2020

(54) BYPASS DIVERTER SUB FOR SUBSURFACE SAFETY VALVES

(71) Applicant: Halliburton Energy Services, Inc., Houston, TX (US)

(72) Inventors: Merced Gonzalez, Dallas, TX (US); Andrew Kelbie, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 15/777,188

(22) PCT Filed: Mar. 11, 2016

(86) PCT No.: PCT/US2016/022165
§ 371 (c)(1),
(2) Date: May 17, 2018

(87) PCT Pub. No.: WO2017/155550
PCT Pub. Date: Sep. 14, 2017

(65) Prior Publication Data

US 2018/0328145 A1 Nov. 15, 2018

(51) Int. Cl.
*E21B 34/10* (2006.01)
*E21B 23/04* (2006.01)

(52) U.S. Cl.
CPC ..... *E21B 34/106* (2013.01); *E21B 23/04* (2013.01); *E21B 34/10* (2013.01)

(58) Field of Classification Search
CPC ..... E21B 34/106; E21B 23/04; E21B 34/10; E21B 17/00; E21B 34/06
See application file for complete search history.

(56) References Cited

U.S. PATENT DOCUMENTS 4,605,070 A 8/1986 Morris
5,598,864 A 2/1997 Johnston et al.
(Continued)

FOREIGN PATENT DOCUMENTS

GB 2423780 A 9/2006
GB 2488687 A 9/2012
(Continued)

OTHER PUBLICATIONS

Gan, "Interim Report to Research Partnership to Secure Energy for America Under Grant RPSEA 07121-1603C, Design Study of a Flapper Style SSSV for XHPHT Applications," Nov. 2009, 92 pages.
(Continued)

*Primary Examiner* — Michael R Wills, III
(74) *Attorney, Agent, or Firm* — McGuireWoods LLP

(57) ABSTRACT

A bypass diverter sub including a housing defining a flow passage, a control line bypass piston arranged within a control line bypass bore defined in a wall of the housing, and a balance line bypass piston arranged within a balance line bypass bore defined in the wall. An outer magnet is disposed within a magnet chamber and is operatively coupled to the control and balance line bypass. A flow tube profile is positioned within the flow passage and provides an inner magnet magnetically coupled to the outer. The flow tube profile is movable between a first position, where control line and balance line pressures circulate through the bypass diverter sub to a subsurface safety valve, and a second position, where the control line pressure is diverted into the flow passage and the balance line pressure is diverted into a balance line jumper conduit.

20 Claims, 4 Drawing Sheets

(56) References Cited

U.S. PATENT DOCUMENTS

| | | | | |
|---|---|---|---|---|
| 6,003,605 | A | 12/1999 | Dickson et al. | |
| 6,659,185 | B2 | 12/2003 | Dennistoun et al. | |
| 7,392,849 | B2 | 7/2008 | Lauderdale et al. | |
| 7,918,280 | B2 | 4/2011 | Mailand et al. | |
| 8,056,637 | B2 | 11/2011 | Larnach | |
| 8,191,634 | B2 | 6/2012 | Xu | |
| 8,662,187 | B2 | 3/2014 | Lake et al. | |
| 2003/0155131 | A1 | 8/2003 | Vick | |
| 2006/0118307 | A1* | 6/2006 | Williamson, Jr. .... | E21B 34/102 166/321 |
| 2006/0196669 | A1* | 9/2006 | Lauderdale ..... | E21B 34/10 166/321 |
| 2009/0114389 | A1 | 5/2009 | Dennistoun et al. | |
| 2011/0240299 | A1 | 10/2011 | Vick, Jr. et al. | |
| 2012/0032099 | A1 | 2/2012 | Vick, Jr. | |
| 2012/0125597 | A1 | 5/2012 | Vick, Jr. | |
| 2014/0262303 | A1 | 9/2014 | Smith et al. | |

FOREIGN PATENT DOCUMENTS

| | | | |
|---|---|---|---|
| WO | WO-2013/039663 | A2 | 3/2013 |
| WO | WO-2013068323 | A1 | 5/2013 |
| WO | 2015094168 | A1 | 6/2015 |

OTHER PUBLICATIONS

Gary et al., "Tubing Retrievable Surface Controlled Subsurface Safety Valve Floating Flapper Remediation," SPE 168271, 2014, 10 pages.

International Search Report and Written Opinion from PCT/US2016/022165, dated Nov. 21, 2016, 22 pages.

Extended European Search Report dated Sep. 16, 2019 issued by the European Patent Office in European Patent Application No. 16 89 3771.

* cited by examiner

BYPASS DIVERTER SUB FOR SUBSURFACE SAFETY VALVES

BACKGROUND

Subsurface safety valves are commonly installed as part of the production tubing within oil and gas wells to protect against unwanted communication of high pressure and high temperature formation fluids to the surface. These subsurface safety valves are designed to shut in fluid production from the formation in response to a variety of abnormal and potentially dangerous conditions.

As built into the production tubing, subsurface safety valves are typically referred to as tubing retrievable safety valves ("TRSV") since they can be retrieved by retracting the production tubing back to surface. TRSVs are normally operated by hydraulic fluid pressure, which is typically controlled at the surface and transmitted to the TRSV via hydraulic control lines. Hydraulic fluid pressure must be applied to the TRSV to place the TRSV in the open position. When hydraulic fluid pressure is lost, the TRSV will transition to the closed position to prevent formation fluids from traveling uphole through the TRSV and reaching the surface. As such, TRSVs are commonly characterized as fail-safe valves, as their default position is closed.

However, as TRSVs are often subjected to years of service in severe operating conditions, failure of the TRSV is possible. For example, a TRSV in the closed position may eventually form leak paths. Alternatively, a TRSV in the closed position may not properly open when actuated. Because of the potential for operational problems in the absence of a properly functioning TRSV, it is vital that the malfunctioning TRSV be promptly replaced or repaired. Since they are incorporated into the production tubing, however, repairing or replacing a malfunctioning TRSV requires removal of the entire production tubing, which can be an expensive undertaking.

To avoid the costs and time of repairing or replacing a malfunctioning TRSV, a wireline retrievable safety valve ("WLRSV") may instead be installed in the TRSV and operated to provide the same safety function as the a TRSV. WLRSVs are typically designed to be lowered into the wellbore from the surface via wireline and are then locked inside the original TRSV. This approach can be a much more efficient and cost-effective alternative to pulling the production tubing to replace or repair the malfunctioning TRSV. One common obstacle in using WLRSVs, however, is how to provide hydraulic pressure to the WLRSV for proper operation once installed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to subsurface safety valves and, more particularly, to a bypass diverter sub used to divert hydraulic fluid pressure from a subsurface safety valve to a wireline retrievable safety valve.

Embodiments described herein provide a bypass diverter sub used to support a tubing retrievable subsurface safety valve and divert control line pressure and balance line pressure from the subsurface safety valve to a wireline retrievable subsurface safety valve when the subsurface safety valve malfunctions or is otherwise inoperable. The bypass diverter sub includes a housing, generally cylindrical, that defines a flow passage. A control line bypass piston is movably arranged within a control line bypass bore defined in a wall of the housing, and a balance line bypass piston is movably arranged within a balance line bypass bore defined in the wall of the housing. An outer magnet is movably disposed within a magnet chamber defined in the wall of the housing. The outer magnet is operatively coupled to the control and balance line bypass pistons such that axial movement of the outer magnet correspondingly moves the control and balance line bypass pistons. A flow tube profile positioned within the flow passage provides an inner magnet magnetically coupled to the outer magnet such that movement of the flow tube profile correspondingly moves the control and balance line bypass pistons.

When it is determined that the subsurface safety valve has malfunctioned or is otherwise inoperable, the flow tube profile can be moved between a first position and a second position. In the first position the control line pressure and balance line pressure circulate through the bypass diverter sub to the subsurface safety valve, whereas in the second position, where the control line pressure is diverted into the flow passage and the balance line pressure is diverted into a balance line jumper conduit. A wireline retrievable safety valve subsequently lowered and positioned within the bypass diverter sub can then use the re-directed control line pressure and balance line pressure to provide the same safety functions as the subsurface safety valve.

Figure 1:
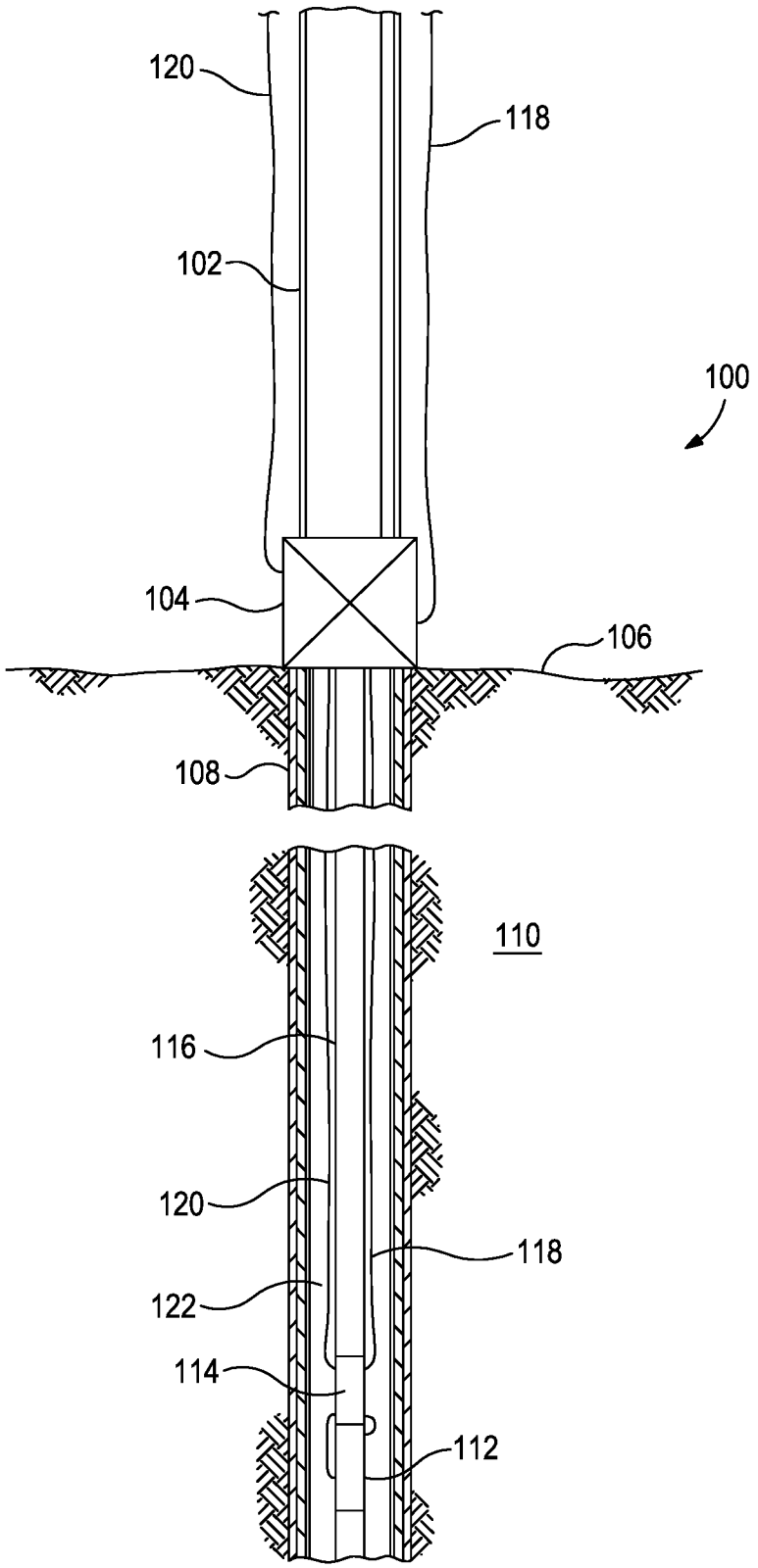
FIG. 1 illustrates a well system that can incorporate the principles of the present disclosure.

FIG. 1 is a well system 100 that can incorporate one or more principles of the present disclosure, according to one or more embodiments. As illustrated, the well system 100 may include a riser 102 extending from a wellhead installation 104 positioned at a sea floor 106. The riser 102 may extend, for example, to an offshore oil and gas platform (not shown). A wellbore 108 extends downward from the wellhead installation 104 through various subterranean formations 110. The wellbore 108 is depicted as being cased, but it could equally be an uncased wellbore 108, without departing from the scope of the disclosure. Although FIG. 1 depicts the well system 100 in the context of an offshore oil and gas application, it will be appreciated by those skilled in the art that the various embodiments disclosed herein are equally well suited for use in land-based applications located at any geographical site. Thus, it should be understood that this disclosure is not limited to any particular type of well.

The well system 100 may further include a subsurface safety valve 112 and a bypass diverter sub 114 interconnected with a tubing string 116 introduced into the wellbore 108 and extending from the wellhead installation 104. The tubing string 116, which may comprise production tubing, may provide a fluid conduit for communicating fluids (e.g., hydrocarbons) extracted from the subterranean formations 110 to the well surface via the wellhead installation 104.

A control line 118 and a balance line 120 may each extend to the wellhead installation 104, which, in turn, conveys the control and balance lines 118, 120 into an annulus 122 defined between the wellbore 108 and the tubing string 116. The control and balance lines 118, 120 may originate from a control manifold or pressure control system (not shown) located at, for example, a production platform, a subsea control station, or a pressure control system located at the earth's surface or downhole. The control and balance lines 118, 120 extend from the wellhead installation 104 within the annulus 122 and eventually communicate with the subsurface safety valve 112 (hereafter "the safety valve 112").

As built into the tubing string 116, the safety valve 112 may be referred to as a tubing retrievable safety valve ("TRSV"). The control line 118 may be used to actuate the safety valve 112 between open and closed positions. More particularly, the control line 118 is a hydraulic conduit that conveys hydraulic fluid to the safety valve 112. The hydraulic fluid is applied under pressure to the control line 118 to open and maintain the safety valve 112 in its open position, thereby allowing production fluids to flow uphole through the safety valve 112, through the tubing string 116, and to a surface location for production. To close the safety valve 112, the hydraulic pressure in the control line 118 is reduced or eliminated. In the event the control line 118 is severed or rendered inoperable, or if there is an emergency at a surface location, the default position for the safety valve 112 is to the closed position to prevent fluids from advancing uphole past the safety valve 112 and otherwise preventing a blowout.

The balance line 120 supplies a balancing hydraulic pressure to compensate for the effects of hydrostatic pressure acting on the control line 118. In order to enable the safety valve 112 to operate at increased depths, it is often necessary to balance the downhole hydrostatic forces assumed by the safety valve 112. The balance line 120 supplies hydraulic pressure to the safety valve 112 to provide a compensating force that overcomes such hydrostatic forces, thereby allowing the safety valve 112 to operate at increased wellbore depths.

According to embodiments of the present disclosure, the hydraulic pressure conveyed through the control and balance lines 118, 120 is first received by the bypass diverter sub 114. As illustrated, the control and balance lines 118, 120 are communicably coupled first to the bypass diverter sub 114 before extending further downhole and connecting to the safety valve 112. The bypass diverter sub 114 may be configured to receive and route the hydraulic pressure from the control and balance lines 118, 120 to the safety valve 112 to operate the safety valve under normal conditions. When it is determined that the safety valve 112 has malfunctioned or is otherwise inoperable, however, the bypass diverter sub 114 may be actuated to re-route the hydraulic pressure to a wireline retrievable safety valve (not shown) subsequently lowered through the tubing string 116 and positioned within the bypass diverter sub 114. Once the wireline retrievable safety valve is properly landed and secured, the bypass diverter sub 114 may be designed and otherwise configured to divert the hydraulic fluid in the control and balance lines 118, 120 to the wireline retrievable safety valve, and thereby enable the wireline retrievable safety valve to provide the same safety functions as the safety valve 112.

Figure 2:
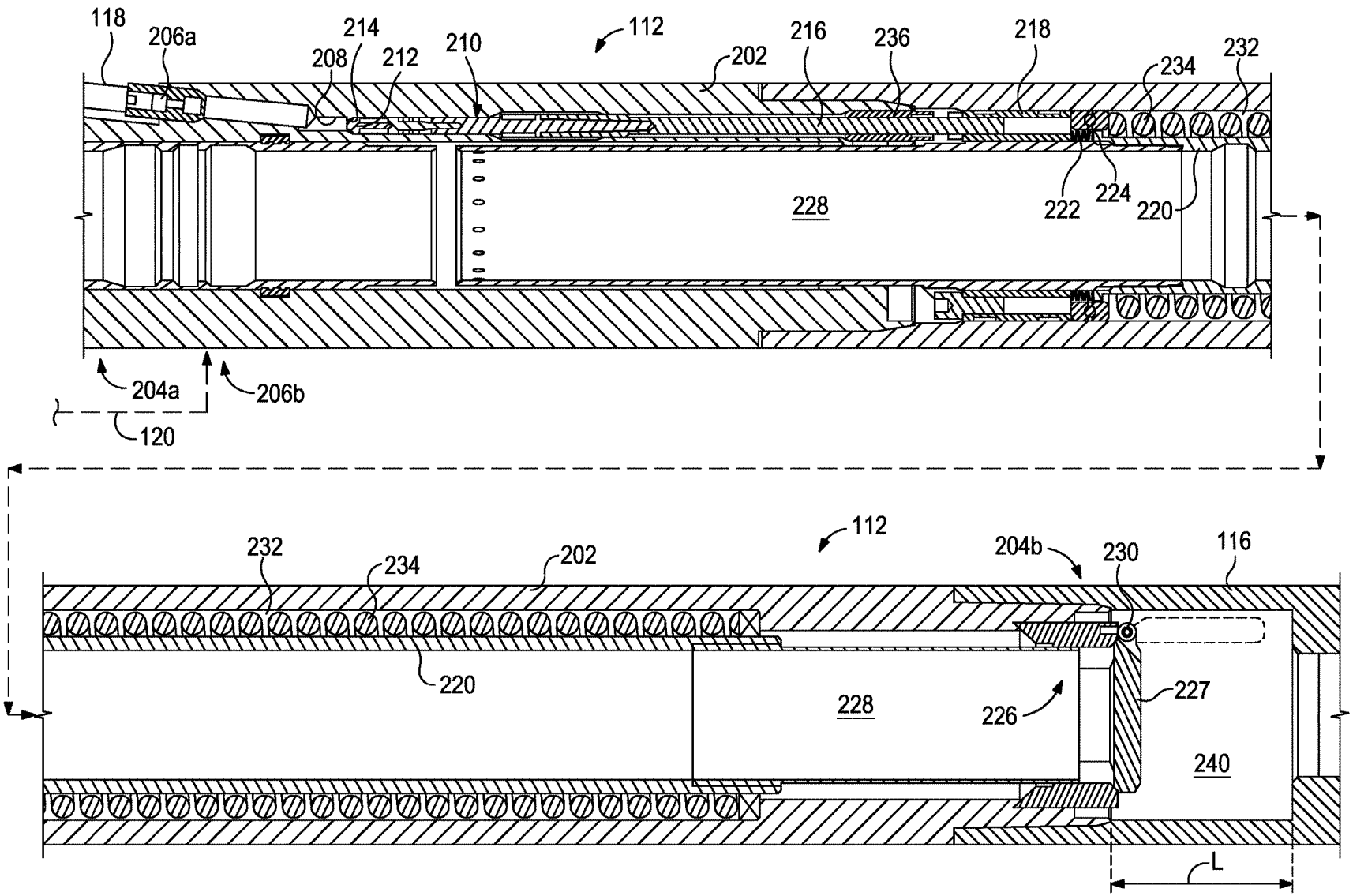
FIG. 2 illustrates progressive cross-sectional side views of the safety valve of FIG. 1.

Referring now to FIG. 2, illustrated are progressive cross-sectional side views of an exemplary embodiment of the safety valve 112 of FIG. 1. The safety valve 112 is depicted in FIG. 2 in successive sectional views, where the upper portion of FIG. 2 depicts an upper portion of the safety valve 112 and the lower portion of FIG. 2 depicts a successive lower portion of the safety valve 112. As illustrated, the safety valve 112 may include a housing 202 having an uphole end 204*a* and a downhole end 204*b*. The bypass diverter sub 114 (FIG. 1) may be operatively coupled to the safety valve 112 at the uphole end 204*a*, and the downhole end 204*b* may be operatively coupled to lower portions of the tubing string 116. As used herein, the term "operatively coupled" refers to a direct or indirect coupling engagement between two components via any known coupling means, such as threading, mechanical fasteners (e.g., bolts, screws, pins, etc.), welding, or any combination thereof.

A control line port 206*a* is provided in the housing 202 for connecting the control line 118 to the safety valve 112. The balance line 120 may be communicably coupled to the housing 202 at a balance line port 206*b* about 90° angularly offset from the control line port 206*a* (only the general location of the balance line port 206*b* is shown in FIG. 2). As indicated above, the control and balance lines 118, 120 may each extend from the bypass diverter sub 114 (FIG. 1). The control line port 206*a* places the control line 118 in fluid communication with a piston bore 208 defined in the housing 202 and able to convey hydraulic fluid pressure thereto. The piston bore 208 may be an elongate channel or conduit that extends longitudinally along a portion of the axial length of the safety valve 112.

A piston assembly 210 is arranged within the piston bore 208 and is configured to translate axially therein. The piston assembly 210 includes a piston head 212 that mates with and otherwise biases an up stop 214 defined within the piston bore 208 when the piston assembly 210 is forced upwards in the direction of the control line port 206*a*. The up stop 214 may be a radial shoulder defined within the piston bore 208 and having a reduced diameter surface configured to engage a corresponding surface of the piston head 212. In other embodiments, the up stop 214 may be any device or means arranged within the piston bore 208 that is configured to stop the axial movement of the piston assembly 210 as it advances toward the control line port 206*a*.

The piston assembly 210 also includes a piston rod 216 that extends longitudinally from the piston assembly 210 through at least a portion of the piston bore 208. At a distal end thereof, the piston rod 216 may be coupled to an actuator sleeve 218, which may effectively couple the piston assembly 210 to a flow tube 220 movably arranged within the safety valve 112. More particularly, the actuator sleeve 218 may engage a biasing device 222 (e.g., a compression spring, a series of Belleville washers, or the like) arranged axially between the actuator sleeve 218 and an actuation flange 224 that forms part of the proximal end of the flow tube 220. As the actuator sleeve 218 acts on the biasing device 222 with axial force, the actuation flange 224 and the flow tube 220 correspondingly move axially.

The safety valve 112 further includes a flapper valve 226 and associated flapper 227 that is selectively movable between open and closed positions to either prevent or allow fluid flow through a flow passage 228 defined through the interior of the safety valve 112. The flapper valve 226 is shown in FIG. 2 in its closed position whereby the flapper 227 is able to substantially block fluid flow into and through the flow passage 228 from downhole (i.e., to the right in FIG. 2). At least one torsion spring 230 biases the flapper 227 to pivot to its closed position.

The flow tube 220 is able to displace downward (i.e., to the right in FIG. 2) to engage the flapper 227 and overcome the spring force of the torsion spring 230. When the flow tube 220 is extended to its downward position, it engages and moves the flapper 227 from its closed position to an open position (shown in dashed lines). When the flow tube 220 is displaced back upward (i.e., to the left in FIG. 2), the torsion spring 230 is able to pivot the flapper 227 back to its closed position. Axial movement of the piston assembly 210 within the piston bore 208 will force the flow tube 220 to correspondingly move axially within the flow passage 228, and either open the flapper 227 or allow it to close, depending on its relative position.

The safety valve 112 may further define a lower chamber 232 within the housing 202. In some embodiments, the lower chamber 232 may form part of the piston bore 208, such as being an elongate extension thereof. A power spring 234, such as a coil or compression spring, may be arranged within the lower chamber 232. The power spring 234 biases the actuation flange 224 and actuation sleeve 218 upwardly which, in turn, biases the piston assembly 210 in the same direction. Accordingly, expansion of the power spring 234 will cause the piston assembly 210 to move upwardly within the piston bore 208.

It should be noted that while the power spring 234 is depicted as a coiled compression spring, any type of biasing device may be used instead of, or in addition to, the power spring 234, without departing from the scope of the disclosure. For example, a compressed gas, such as nitrogen, with appropriate seals may be used in place of the power spring 234. In other embodiments, the compressed gas may be contained in a separate chamber and tapped when needed.

Exemplary operation of the safety valve 112 to selectively open and close the flapper 227 is now provided. Hydraulic pressure may be conveyed to the control line port 206*a* via the control line 118. As hydraulic pressure is provided to the piston bore 208, the piston assembly 210 is forced to move axially downward within the piston bore 208 and the piston rod 216 mechanically transfers the hydraulic force to the actuation sleeve 218 and the actuation flange 224, thereby correspondingly displacing the flow tube 220 in the downward direction. In other words, as the piston assembly 210 moves axially within the piston bore 208, the flow tube 220 correspondingly moves in the same direction. As the flow tube 220 moves downward, it engages the flapper 227, overcomes the spring force of the torsion spring 230, and thereby pivots the flapper 227 to its open position to permit fluids to enter the flow passage 228 from downhole.

As the piston assembly 210 moves axially downward within the piston bore 208, the power spring 234 is compressed within the lower chamber 232 and progressively builds spring force. In at least one embodiment, the piston assembly 210 will continue its axial movement in the downward direction, and thereby continue to compress the power spring 234, until engaging a down stop 236 arranged within the piston bore 208. A metal-to-metal seal may be created between the piston assembly 210 and the down stop 236 such that the migration of fluids (e.g., hydraulic fluids, production fluids, etc.) therethrough is generally prevented.

When it is desired to close the flapper 227, the hydraulic pressure provided via the control line 118 may be reduced or eliminated, thereby allowing the spring force built up in the power spring 234 to release and displace the piston assembly 210 upwards within the piston bore 208, and thereby correspondingly moving the flow tube 220 in the same direction. As the flow tube 220 moves axially upwards, it will eventually move out of engagement with the flapper 227, thereby allowing the spring force of the torsion spring 230 to pivot the flapper 227 back into its closed position.

The piston assembly 210 will continue its axial movement in the upward direction until the piston head 212 of the piston assembly 210 engages the up stop 214 and effectively prevents the piston assembly 210 from further upward movement. Engagement between the piston head 212 and the up stop 214 may generate a mechanical metal-to-metal seal between the two components to prevent the migration of fluids (e.g., hydraulic fluids, production fluids, etc.) therethrough.

To enable the safety valve 112 to operate at depths where the biasing force provided by power spring 234 would be overcome by the hydrostatic force of the fluid in the control line 118, it is necessary to balance the hydrostatic forces. In order to counteract the hydrostatic head of the control line 118, the balance line 120 supplies hydraulic pressure below the piston assembly 210. Thus, when the safety valve 112 is positioned at a depth where the hydrostatic head in the control line 118 is sufficient to overcome the biasing force of power spring 234, a compensating force may be applied via the balance line 120. The balancing force allows the safety valve 112 to be positioned at various depths irrespective of the biasing force applied by power spring 234.

Figure 3A:
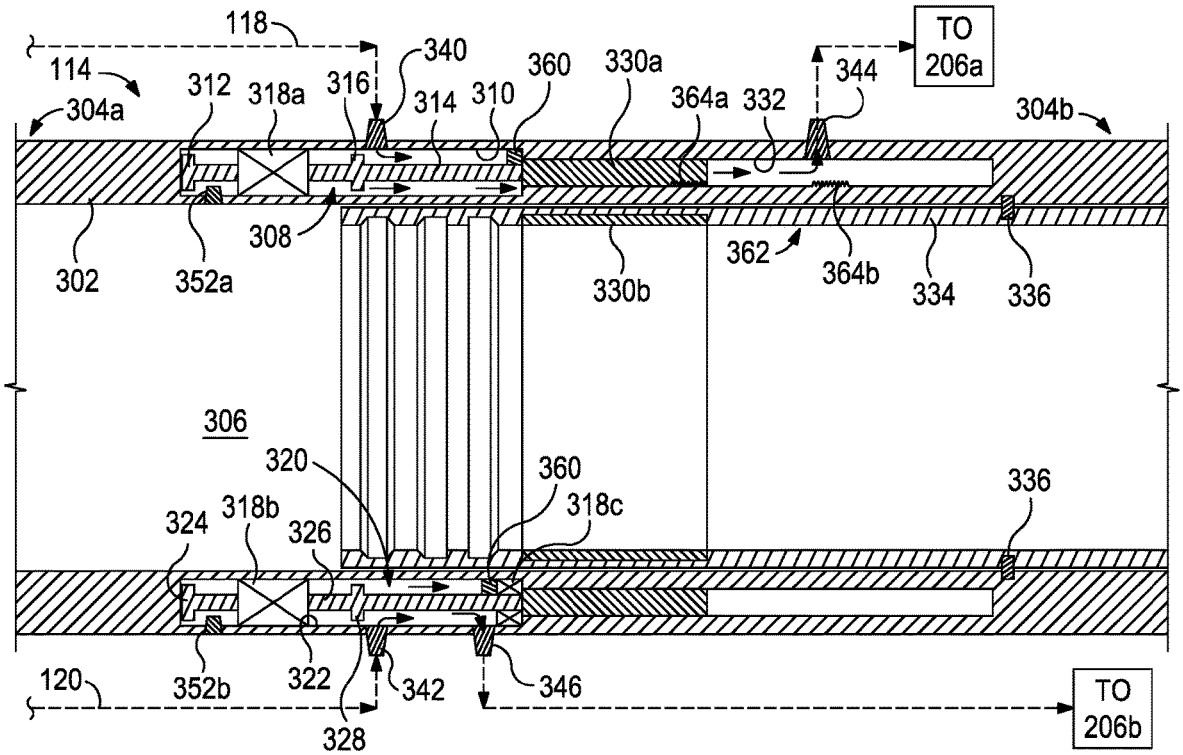
FIGS. 3A and 3B are cross-sectional side views of an exemplary embodiment of the bypass diverter sub of FIG. 1.
Figure 3B:
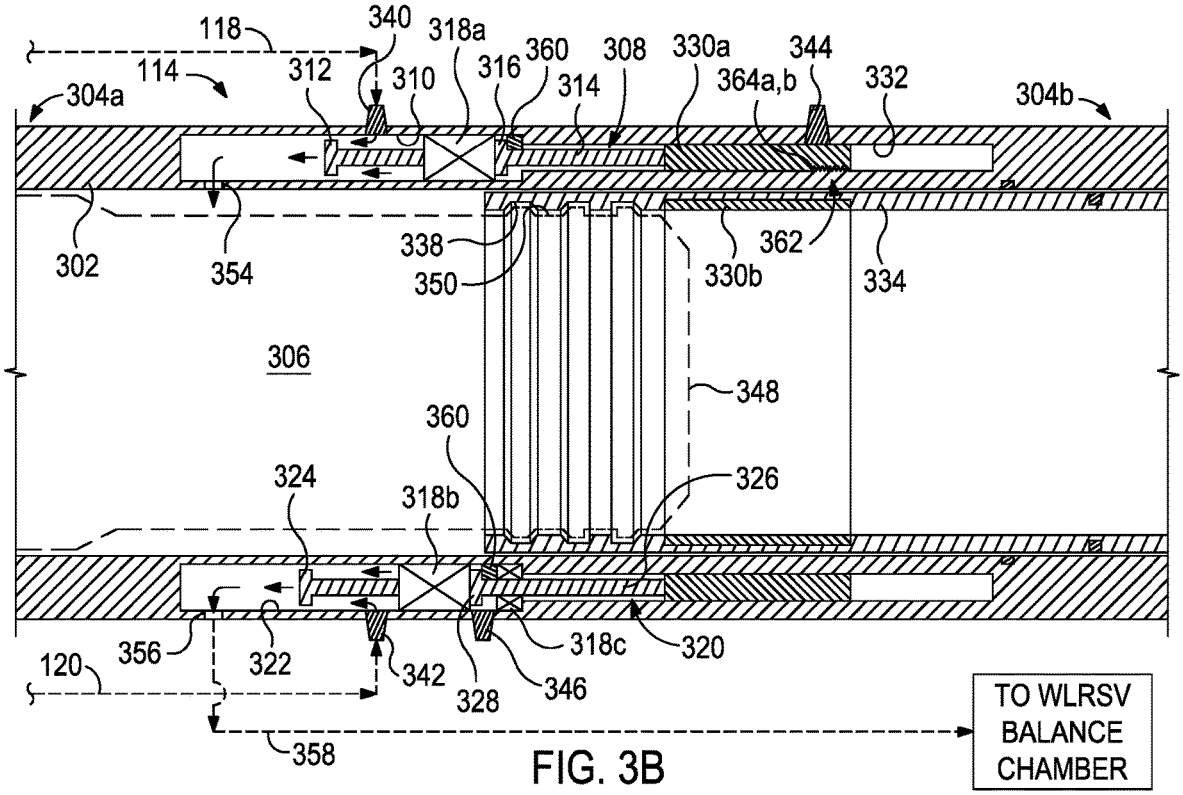

FIGS. 3A and 3B are cross-sectional side views of an exemplary embodiment of the bypass diverter sub 114 of FIG. 1, according to one or more embodiments. As illustrated, the bypass diverter sub 114 may include an elongate, generally cylindrical housing 302 having a first or uphole end 304*a* and a second or downhole end 304*b*. A flow passage 306 is defined within the housing 302 and extends between the uphole and downhole ends 304*a,b*. The uphole end 304*a* of the housing 302 may be operatively coupled to the tubing string 116 (FIG. 1), and the downhole end 304*b* may be operatively coupled to the uphole end 204*a* (FIG. 2) of the safety valve 112 (FIG. 2). Accordingly, the flow passage 306 of the bypass diverter sub 114 may fluidly communicate with the tubing string 116 and the flow passage 228 (FIG. 2) of the safety valve 112.

The bypass diverter sub 114 may also include a control line bypass piston 308 movably arranged within a control line bypass bore 310 defined in the wall of the housing 302. As illustrated, the control line bypass piston 308 may include a head 312 and an elongate shaft 314 extending axially from the head 312. The head 312 may exhibit an outer diameter that is greater than that of the elongate shaft 314. The control line bypass piston 308 may also include a radial shoulder 316 disposed at an intermediate location between the head 312 and the opposing end of the elongate shaft 314. Similar to the head 312, the radial shoulder 316 exhibits an outer diameter greater than that of the elongate shaft 314.

A first dynamic seal 318*a* may be positioned within the control line bypass bore 310 and arranged about the elongate shaft 314 between the head 312 and the radial shoulder 316. As used herein, the term "dynamic seal" is used to indicate a seal that provides pressure and/or fluid isolation between members that have relative displacement therebetween, for example, a seal that seals against a displacing surface, or a seal carried on one member and sealing against the other member. The first dynamic seal 318*a* may be configured to "dynamically" seal against the outer surface of the elongate shaft 314 and the inner wall of the control line bypass bore 310 as the control line bypass piston 308 axially translates within the control line bypass bore 310. When stationary, the first dynamic seal 318*a* may provide a point of fluid isolation within the control line bypass bore 310.

The first dynamic seal 318*a* may be made of a variety of materials including, but not limited to, an elastomeric material, a metal, a composite, a rubber, a ceramic, any derivative thereof, and any combination thereof. In some embodiments, the first dynamic seal 318*a* may comprise one or more O-rings or the like. In other embodiments, however, the first dynamic seal 318*a* may comprise a set of v-rings or CHEVRON® packing rings, or another appropriate seal configuration (e.g., seals that are round, v-shaped, u-shaped, square, oval, t-shaped, etc.), as generally known to those skilled in the art.

The bypass diverter sub 114 may further include a balance line bypass piston 320 movably arranged within a balance line bypass bore 322 defined in the wall of the housing 302. In the illustrated embodiment, the control line and balance line bypass bores 310, 322 are angularly offset from each other by 180° in the housing 302. In other embodiments, however, the control line and balance line bypass bores 310, 322 may be angularly offset from each other by other angles, such as 45°, 90°, 135°, or any angle falling between 0° and 180°, without departing from the scope of the disclosure.

The balance line bypass piston 320 may be substantially similar to the control line bypass piston 308. More particularly, the balance line bypass piston 320 may also include a head 324, an elongate shaft 326, and a radial shoulder 328 disposed at an intermediate location between the head 324 and the opposing end of the elongate shaft 326. Moreover, the head 324 and the radial shoulder 328 may each exhibit an outer diameter that is greater than that of the elongate shaft 326.

A second dynamic seal 318*b* may be positioned within the balance line bypass bore 322 and arranged about the elongate shaft 326 between the head 324 and the radial shoulder 328. The second dynamic seal 318*b* may be configured to dynamically seal against the outer surface of the elongate shaft 326 and the inner wall of the balance line bypass bore 322 as the balance line bypass piston 320 axially translates within the balance line bypass bore 322. When stationary, the second dynamic seal 318*b* may provide a point of fluid isolation within the balance line bypass bore 322. The second dynamic seal 318*b* may be made of similar materials and construct as the first dynamic seal 318*a*.

The bypass diverter sub 114 may also provide a first or outer magnet 330*a* movably disposed within a magnet chamber 332 defined in the wall of the housing 302. The magnet chamber 332 may comprise an annular cavity and may fluidly communicate with the control line bypass bore 310, but a third dynamic seal 318*c* arranged in the balance line bypass bore 322 prevents fluid communication between the magnet chamber 332 and the balance line bypass bore 322. The third dynamic seal 318*c* may be configured to dynamically seal against the outer surface of the elongate shaft 326 and the inner wall of the balance line bypass bore 322 as the balance line bypass piston 320 axially translates within the balance line bypass bore 322. The third dynamic seal 318*c* may be made of similar materials and construct as the first and second dynamic seals 318*a,b*.

The control and balance line bypass pistons 308, 320 may each be operatively coupled to the outer magnet 330*a* such that axial movement of the outer magnet 330*a* within the magnet chamber 332 correspondingly moves the control and balance line bypass pistons 308, 320 within the control and balance line bypass bores 310, 322, respectively. In some embodiments, for example, the ends of the elongate shafts 314, 326 may be directly coupled to the outer magnet 330*a* via any known coupling means, such as threading, mechanical fasteners (e.g., bolts, screws, pins, etc.), welding, or any combination thereof. In other embodiments, however, one or both of the ends of the elongate shafts 314, 326 may be indirectly coupled to the outer magnet 330*a* with one or more interposing structural components (not shown).

In some embodiments, the outer magnet 330*a* may comprise a monolithic, annular structure. In other embodiments, however, the outer magnet 330*a* may comprise two or more arcuate segments or sections coupled together. In some embodiments, the outer magnet 330*a* may comprise any type of permanent magnet including, but not limited to, neodymium iron boron (NdFeB) magnets, bonded NdFeB magnets, samarium cobalt magnets, alnico magnets, ceramic (hard ferrite) magnets, and any combination thereof. In other embodiments, however, the outer magnet 330*a* may comprise an electromagnet that is manually or programmably activated.

The bypass diverter sub 114 may further include a flow tube profile 334 positioned within the flow passage 306. The flow tube profile 334 may comprise a sleeve-like, generally cylindrical, structure that is movable between a first position, as shown in FIG. 3A, and a second position, as shown in FIG. 3B. In some embodiments, the flow tube profile 334 may be secured to the housing 302 in the first position with one or more shearable devices 336, such as shear pins, shear screws, a shear ring, etc. As illustrated, the flow tube profile 334 may include an inner profile 338 defined on its inner radial surface. A lockout tool 348 (FIG. 3B) may be configured to locate and mate with the inner profile 338, as will be described in more detail below. Once coupled to the flow tube profile 334 at the inner profile 338, the lockout tool 348 may then be used to shear the shearable devices 336 and help move the flow tube profile 334 to the second position.

An inner magnet 330*b* may be coupled to and otherwise form an integral part of the flow tube profile 334. Similar to the outer magnet 330*a*, the inner magnet 330*b* may comprise a monolithic, annular structure but may alternatively comprise two or more arcuate segments or sections coupled together. Moreover, similar to the outer magnet 330*a*, the inner magnet 330*b* may comprise any type of permanent magnet, but could alternatively comprise an electromagnet that is manually or programmably activated.

The outer and inner magnets 330*a,b* may be concentrically arranged within the housing 302 and magnetically coupled. As a result, any axial movement of the inner magnet 330*b* correspondingly moves the outer magnet 330*a* within the magnet chamber 332, which, as mentioned above, will cause the control and balance line bypass pistons 308, 320 to also move within the control and balance line bypass bores 310, 322, respectively. Accordingly, moving the flow tube profile 334 from the first position (FIG. 3A) to the second position (FIG. 3B) correspondingly moves the control and balance line bypass pistons 308, 320.

A control line port 340 may be provided in the housing 302 for connecting the control line 118 to the bypass diverter sub 114. More particularly, the control line port 340 places the control line 118 in fluid communication with the control line bypass bore 310 to convey control line pressure thereto. A balance line port 342 may also be provided in the housing 302 for connecting the balance line 120 to the bypass diverter sub 114 and, more particularly, for placing the balance line 120 in fluid communication with the balance line bypass bore 322 to convey balance line pressure thereto. As used herein, "control line pressure" and "balance line pressure" refer to the fluid pressure exerted by the hydraulic fluid provided in the control line 118 and the balance line 120, respectively.

With continued reference to FIGS. 3A-3B, exemplary operation of the bypass diverter sub 114 is now provided. FIG. 3A depicts the bypass diverter sub 114 in a first or normal operating configuration, and FIG. 3B depicts the bypass diverter sub 114 in a second or bypass operating configuration. In the normal operating configuration, control line pressure from the control line 118 and balance line pressure from the balance line 120 are each able to circulate through the bypass diverter sub 114 and to the safety valve 112 (FIG. 2) so that the safety valve 112 may be properly operated. More particularly, the control line pressure is provided to the control line bypass bore 310 via the control line 118 and the control line port 340. The first dynamic seal 318*a* prevents the control line pressure from migrating past and to the head 312 of the control line bypass piston 308. Rather, the control line pressure is forced toward the opposing end of the control line bypass piston 308 and into the magnet chamber 332, as indicated by the arrows. The outer magnet 330*a* does not sealingly engage the inner walls of the magnet chamber 332 and, therefore, the control line pressure is able to migrate past the outer magnet 330*a* into the magnet chamber 332. The control line pressure may then escape the magnet chamber 332 via a control line outlet 344, which conveys the control line pressure to the control line port 206*a* of the safety valve 112.

Moreover, the balance line pressure is provided to the balance line bypass bore 322 via the balance line 120 and the balance line port 342. The second dynamic seal 318*b* prevents the balance line pressure from migrating to the head 324 of the balance line bypass piston 320, and the third dynamic seal 318*c* prevents the balance line pressure from migrating into the magnet chamber 332. Accordingly, the control line and balance line pressures do not intermingle in the magnet chamber 332. Rather, the balance line pressure escapes the balance line bypass bore 322 via a balance line outlet 346 provided in the housing 302, which conveys the balance line pressure to the balance line port 206*b* of the safety valve 112 (FIG. 2).

In the event the safety valve 112 (FIG. 2) malfunctions or is otherwise rendered inoperable, the bypass diverter sub 114 may be actuated to the bypass operating configuration to provide the control line pressure and the balance line pressure to a wireline retrievable safety valve. To accomplish this, a lockout tool 348 (FIG. 3B) may be advanced through the tubing string 116 to the bypass diverter sub 114. In some embodiments, the lockout tool 348 may be attached to wireline or slickline deployed from a surface location and advanced downhole either under the force of gravity or by hydraulic pressure applied to the tubing string 116. In other embodiments, however, the lockout tool 348 may be attached to a string of tubular members, such as production tubing or drill pipe and advanced to the bypass diverter sub 114.

Upon locating the bypass diverter sub 114, the lockout tool 348 may be configured to couple to the flow tube profile 334. More particularly, the lockout tool 348 may define an outer profile 350 configured to mate with the inner profile 338 of the flow tube profile 334. In some embodiments, the outer profile 350 may comprise a machined surface that matches the inner profile 338. In other embodiments, however, the outer profile 350 may comprise one or more spring-loaded, actuatable, or retractable keys, dogs, or lugs that may be able to match the inner profile 338.

Once the lockout tool 348 is coupled to the flow tube profile 334, an axial load may be applied to the flow tube profile 334 to shear the shearable devices 336 and thereby free the flow tube profile 334 from the housing 302. In some embodiments, the axial load may comprise an impact force resulting from downward jarring of the lockout tool 348 from a surface location. In other embodiments, however, the axial load may comprise a hydraulic force applied by the lockout tool 348 to the flow tube profile 334. More particularly, the lockout tool 348 may be sized and otherwise configured to seal or substantially seal against the inner walls of the tubing string 116 (FIG. 1). In such cases, pressurizing the tubing string 116 uphole from the lockout tool 348 may place a hydraulic load on the lockout tool 348 that is converted into an axial load required to fail the shearable devices 336.

With the shearable devices 336 broken, the flow tube profile 334 is then free to move axially within the flow passage 306. Applying fluid pressure within the tubing string 116 (FIG. 1) uphole from the lockout tool 348 will place an axial load on the flow tube profile 334 that moves the flow tube profile 334 in the downhole direction (i.e., from left to right in FIGS. 3A-3B) from the first position (FIG. 3A) to the second position (FIG. 3B). As the flow tube profile 334 moves in the downhole direction, the outer magnet 330*a* correspondingly moves within the magnet chamber 332, since it is magnetically coupled to the inner magnet 330*b* moving with the flow tube profile 334. Moreover, since the control and balance line bypass pistons 308, 320 are each operatively coupled to the outer magnet 330*a*, moving the flow tube profile 334 also results in moving the control and balance line bypass pistons 308, 320 in the downhole direction within the control and balance line bypass bores 310, 322, respectively.

Moving the control line bypass piston 308 in the downhole direction may shear a first shear plug 352*a* arranged in the control line bypass bore 310. More particularly, the enlarged diameter of the head 312 of the control line bypass piston 308 may engage the first shear plug 352*a* as the control line bypass piston 308 moves in the downhole direction. Upon assuming a sufficient axial load, the head 312 may overcome the shear limit of the first shear plug 352*a*. When intact, the first shear plug 352*a* keeps pressure in the flow passage 306 from entering the control line bypass bore 310 and inadvertently stroking the control line bypass piston 308 downward. Upon shearing the first shear plug 352*a*, however, an interior control line port 354 becomes exposed and places the control line bypass bore 310 in fluid communication with the flow passage 306. Once the interior control line port 354 is exposed, control line pressure will be diverted into the flow passage 306 and sensed at surface since it will no longer be possible to hold pressure within the control line 118. As will be appreciated, this will provide a positive indication that the flow tube profile 334 has moved to the second position.

Moving the balance line bypass piston 320 in the downhole direction may shear a second shear plug 352*b* arranged in the balance line bypass bore 322, and thereby expose an exterior balance line port 356. More particularly, the enlarged diameter of the head 324 of the balance line bypass piston 320 may engage the second shear plug 352*b* as the balance line bypass piston 320 moves in the downhole direction and, upon assuming a sufficient axial load, the head 324 may shear the second shear plug 352*b*. The exterior balance line port 356 may place the balance line bypass bore 322 in fluid communication with a balance line jumper conduit 358.

The control and balance line bypass pistons 308, 320 may be moved axially in the downhole direction until engaging corresponding down stops 360 arranged in the control and balance line bypass bores 310, 322, respectively. More particularly, the radial shoulders 316, 328 of the control and balance line bypass pistons 308, 320, respectively, may each engage a corresponding down stop 360 and thereby prevent further axial movement of the control and balance line bypass pistons 308, 320. Moreover, moving the control and balance line bypass pistons 308, 320 axially in the downhole direction correspondingly moves the first and second dynamic seals 318*a,b* such that the first dynamic seal 318*a* is moved axially past the control line port 340 and the second dynamic seal 318*b* is moved axially past the balance line port 340.

The bypass diverter sub 114 may be maintained in the bypass operating configuration using a locking mechanism 362. In at least one embodiment, as shown in FIGS. 3A-3B, the locking mechanism 362 may be arranged in the magnet chamber 332 and may comprise a series of angled teeth 364*a* defined on the outer magnet 330*a* and an opposing series of angled teeth 364*b* defined on the wall of the magnet chamber 332. The angled teeth 364*a* on the outer magnet 330*a* may be angled such that the outer magnet 330*a* is able to ratchet over the angled teeth 364*b* of the magnet chamber 332 as the outer magnet 330*a* moves in the downhole direction within the magnet chamber 332. Once the angled teeth 364*a,b* intermesh, however, as shown in FIG. 3B, movement in the uphole direction (i.e., to the left in FIG. 3B) is substantially prevented. Accordingly, the locking mechanism 362 may be configured to prevent the control and balance line bypass pistons 308, 320 from retracting back uphole.

Referring specifically to FIG. 3B, with the bypass diverter sub 114 in the bypass operating configuration, the first dynamic seal 318*a* prevents the control line pressure provided to the control line bypass bore 310 from entering the magnet chamber 332. Rather, the control line pressure is able to escape the control line bypass bore 310 into the flow passage 306 via the now-exposed interior control line port 354, as indicated by the arrows. Moreover, with the bypass diverter sub 114 in the bypass operating configuration, the second dynamic seal 318*b* prevents the balance line pressure provided to the balance line bypass bore 322 from accessing the balance line outlet 346. Rather, the balance line pressure is able to escape the balance line bypass bore 322 into the balance line jumper conduit 358 via the now-exposed exterior balance line port 356, as indicated by the arrows. As indicated in FIG. 3B, the balance line jumper conduit 358 may be configured to convey the balance pressure to a balance chamber of a wireline retrievable safety valve (WLRSV). With the bypass diverter sub 114 in the bypass operating configuration, a wireline retrievable safety valve (not shown) may be introduced into the tubing string 116 (FIG. 1), which, as indicated above, may replace the functionality of the safety valve 112 (FIG. 2).

Figure 4:
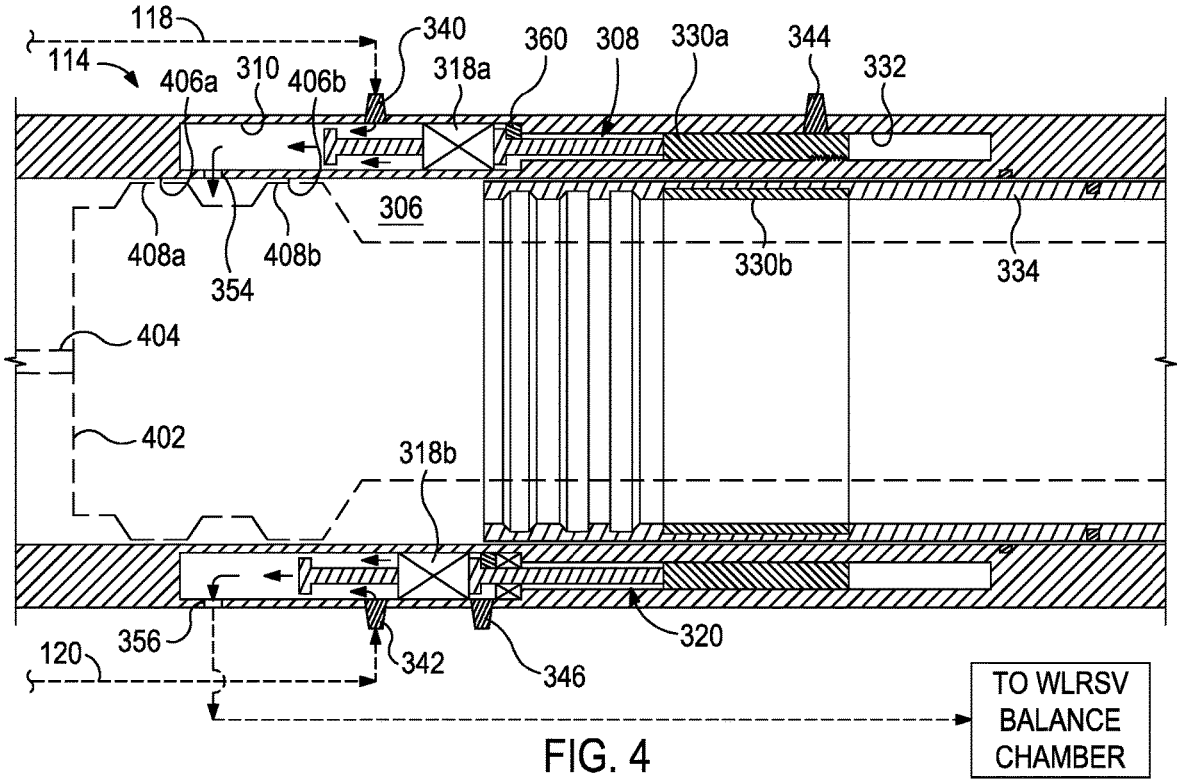
FIG. 4 is a cross-sectional side view of the bypass diverter sub of FIGS. 3A and 3B with an exemplary wireline retrievable safety valve positioned therein.

FIG. 4 illustrates a cross-sectional side view of the bypass diverter sub 114 with an exemplary wireline retrievable safety valve 402 positioned therein, according to one or more embodiments. The wireline retrievable safety valve 402 may be advanced within the tubing string 116 (FIG. 1) on a conveyance 404 (e.g., wireline, slickline, coiled tubing, etc.) to the bypass diverter sub 114. The bypass diverter sub 114 may provide and otherwise define upper and lower seal bores 406*a* and 406*b* on opposing axial sides of the interior control line port 354. Securing the wireline retrievable safety valve 402 within the bypass diverter sub 114 may include straddling the interior control line port 354 and sealing against the upper and lower seal bores 406*a,b* with packing seals 408*a* and 408*b*, respectively, included in the wireline retrievable safety valve 402. As a result, the control line pressure escaping the control line bypass bore 310 via the interior control line port 354 may be fed into the wireline retrievable safety valve 402 and used to actuate the wireline retrievable safety valve 402 between open and closed positions.

Figure 5A:
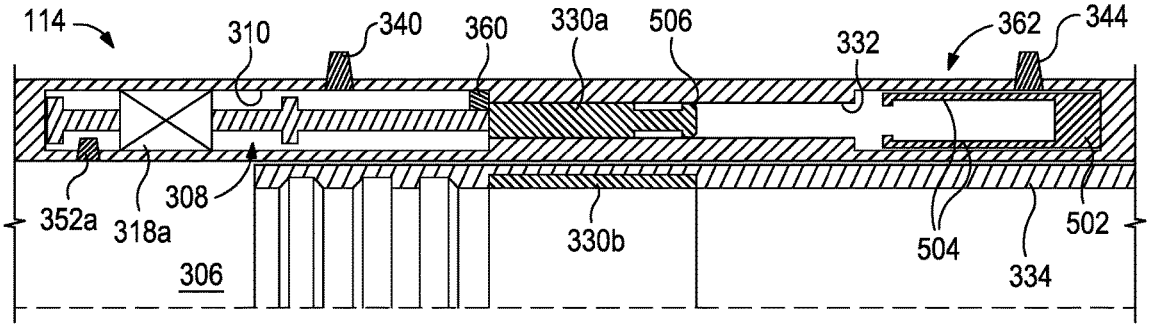
FIGS. 5A and 5B depict an alternative configuration of the locking mechanism of FIGS. 3A and 3B.
Figure 5B:
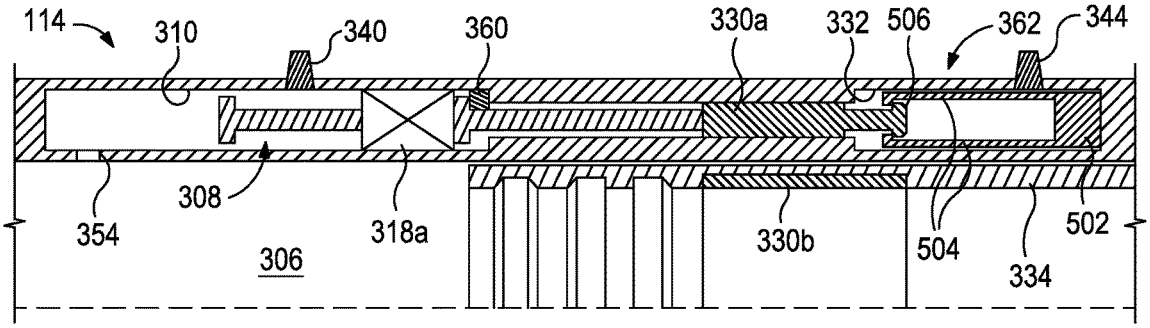

FIGS. 5A and 5B depict an alternative configuration of the locking mechanism 362 used to maintain the bypass diverter sub 114 in the bypass operating configuration, according to one or more embodiments. More particularly, FIGS. 5A and 5B are cross-sectional side views of a portion of the bypass diverter sub 114, where FIG. 5A depicts the bypass diverter sub 114 in the normal operating configuration, and FIG. 5B depicts the bypass diverter sub 114 in the bypass operating configuration, as generally described above.

Unlike the embodiment shown in FIGS. 3A-3B, the locking mechanism 362 may provide and otherwise define a collet-style locking mechanism. More specifically, a collet 502 may be arranged in the magnet chamber 332 and may include one or more axially extending collet fingers 504. The end of the outer magnet 330*a* may define an external fish neck 506 configured to be received by the collet fingers 504. As the flow tube profile 334 moves in the downhole direction, the outer magnet 330*a* correspondingly moves within the magnet chamber 332 since it is magnetically coupled to the inner magnet 330*b* which moves with the flow tube profile 334. The external fish neck 506 eventually engages the collet fingers 504, which flex radially outward to receive and secure the external fish neck 506. Once the collet fingers 504 receive the external fish neck 506, movement of the outer magnet 330*a* back in the uphole direction (i.e., to the left in FIGS. 5A-5B) is substantially prevented. Accordingly, the locking mechanism 362 shown in FIGS. 5A-5B may also be configured to prevent the control and balance line bypass pistons 308, 320 from moving back uphole.

Embodiments disclosed herein include:

A. A bypass diverter sub that includes a housing defining a flow passage, a control line bypass piston movably arranged within a control line bypass bore defined in a wall of the housing, a balance line bypass piston movably arranged within a balance line bypass bore defined in the wall of the housing, an outer magnet movably disposed within an magnet chamber defined in the wall of the housing, the outer magnet being operatively coupled to the control and balance line bypass pistons such that axial movement of the outer magnet correspondingly moves the control and balance line bypass pistons, and a flow tube profile positioned within the flow passage and providing an inner magnet magnetically coupled to the outer magnet such that movement of the flow tube profile correspondingly moves the control and balance line bypass pistons. The flow tube profile is movable between a first position, where control line pressure circulates through the control line bypass bore and the magnet chamber, and balance line pressure circulates through the balance line bypass bore, to a second position, where the control line pressure is diverted into the flow passage and the balance line pressure is diverted into a balance line jumper conduit.

B. A well system that includes a tubing string extendable within a wellbore, a subsurface safety valve interconnected with the tubing string, a bypass diverter sub interconnected with the tubing string and operatively coupled to the subsurface safety valve, a control line providing control line pressure to the bypass diverter sub, a balance line providing balance line pressure to the bypass diverter sub. The bypass diverter sub includes a housing having a first end operatively coupled to the tubing string, a second end operatively coupled to the subsurface safety valve, and a flow passage that extends at least partially between the first and second ends, a control line bypass piston movably arranged within a control line bypass bore defined in a wall of the housing and in fluid communication with the control line, a balance line bypass piston movably arranged within a balance line bypass bore defined in the wall of the housing and in fluid communication with the balance line, an outer magnet movably disposed within an magnet chamber defined in the wall of the housing, the outer magnet being operatively coupled to the control and balance line bypass pistons such that axial movement of the outer magnet correspondingly moves the control and balance line bypass pistons, and a flow tube profile positioned within the flow passage and providing an inner magnet magnetically coupled to the outer magnet such that movement of the flow tube profile correspondingly moves the control and balance line bypass pistons. The flow tube profile is movable between a first position, where the control line pressure circulates through the control line bypass bore, the magnet chamber, and to the subsurface safety valve, and the balance line pressure circulates through the balance line bypass bore and to the subsurface safety valve, to a second position, where the control line pressure is diverted into the flow passage and the balance line pressure is diverted into a balance line jumper conduit.

C. A method that includes conveying control line pressure to a bypass diverter sub interconnected with a tubing string extended within a wellbore, the bypass diverter sub providing a housing that defines a flow passage, receiving the control line pressure at a control line bypass bore defined in a wall of the housing and directing the control line pressure to a subsurface safety valve interconnected with the tubing string via a magnet chamber defined in the wall of the housing, conveying balance line pressure to the bypass diverter sub, receiving the balance line pressure at a balance line bypass bore defined in a wall of the housing and directing the balance line pressure to the subsurface safety valve via the balance line bypass bore, and moving a flow tube profile positioned within the flow passage from a first position, where the control line pressure and the balance line pressure circulate to the subsurface safety valve, and to a second position, where the control line pressure is diverted into the flow passage and the balance line pressure is diverted into a balance line jumper conduit.

Each of embodiments A, B, and C may have one or more of the following additional elements in any combination: Element 1: further comprising a first dynamic seal movable with the control line bypass piston within the control line bypass bore, a second dynamic seal movable with the balance line bypass piston within the balance line bypass bore, and a third dynamic seal positioned in the balance line bypass bore to prevent fluid communication between the magnet chamber and the balance line bypass bore. Element 2: wherein the flow tube profile further defines an inner profile that receives an outer profile of a lockout tool used to move the flow tube profile from the first position to the second position. Element 3: further comprising one or more shearable devices that secure the flow tube profile to the housing. Element 4: further comprising a first shear plug arranged in the control line bypass bore and shearable by the control line bypass piston when the flow tube profile moves to the second position, whereby an interior control line port becomes exposed and places the control line bypass bore in fluid communication with the flow passage, and a second shear plug arranged in the balance line bypass bore and shearable by the balance line bypass piston when the flow tube profile moves to the second position, whereby an exterior balance line port becomes exposed and places the balance line bypass bore in fluid communication with a balance line jumper conduit. Element 5: further comprising a locking mechanism that secures the outer magnet and the control and balance line bypass pistons in position after the flow tube profile moves to the second position. Element 6: wherein the locking mechanism comprises a series of first angled teeth defined on the outer magnet, and a series of second angled teeth defined on a wall of the magnet chamber, wherein the series of first and second angled teeth are angled such that the outer magnet is able to ratchet over the second series of angled teeth as the outer magnet moves in a first direction, but prevent the outer magnet from moving in a second direction opposite the first direction. Element 7: wherein the locking mechanism comprises a collet arranged in the magnet chamber including one or more axially extending collet fingers, an external fish neck defined on an end of the outer magnet and configured to be received by the collet fingers.

Element 8: wherein the flow tube profile further defines an inner profile, the well system further comprising a lockout tool providing an outer profile that mates with the inner profile and moves the flow tube profile from the first position to the second position. Element 9: further comprising a first shear plug arranged in the control line bypass bore and shearable by the control line bypass piston when the flow tube profile moves to the second position, whereby an interior control line port becomes exposed and places the control line bypass bore in fluid communication with the flow passage, and a second shear plug arranged in the balance line bypass bore and shearable by the balance line bypass piston when the flow tube profile moves to the second position, whereby an exterior balance line port becomes exposed and places the balance line bypass bore in fluid communication with a balance line jumper conduit. Element 10: further comprising a locking mechanism that secures the outer magnet and the control and balance line bypass pistons in position after the flow tube profile moves to the second position. Element 11: further comprising a wireline retrievable safety valve positionable within the bypass diverter sub, wherein the wireline retrievable safety valve receives the control line pressure diverted into the flow passage, and wherein the wireline retrievable safety valve provides a balance chamber communicably coupled to the balance line jumper conduit for receiving the balance line pressure diverted into the balance line jumper conduit.

Element 12: wherein the bypass diverter sub further includes a control line bypass piston movably arranged within the control line bypass bore, a balance line bypass piston movably arranged within the balance line bypass bore, wherein moving a flow tube profile positioned within the flow passage further comprises moving an inner magnet coupled to the flow tube profile, moving an outer magnet movably disposed within the magnet chamber and magnetically coupled to the inner magnet, wherein the outer magnet is operatively coupled to the control and balance line bypass pistons, and moving the control and balance line bypass pistons as the outer and inner magnets move. Element 13: further comprising securing the outer magnet and the control and balance line bypass pistons in position with a locking mechanism after the flow tube profile moves to the second position. Element 14: wherein, when the flow tube profile is in the second position, the method further comprises preventing the control line pressure from reaching the subsurface safety valve with a first dynamic seal movable with the control line bypass piston within the control line bypass bore, preventing the balance line pressure from reaching the subsurface safety valve with a second dynamic seal movable with the balance line bypass piston within the balance line bypass bore, and preventing fluid communication between the magnet chamber and the balance line bypass bore with a third dynamic seal positioned in the balance line bypass bore. Element 15: wherein the flow tube profile further defines an inner profile and moving the flow tube profile from the first position to the second position comprises conveying a lockout tool having an outer profile to the bypass diverter sub, coupling the lockout tool to the flow tube profile by mating the inner and outer profiles, and applying an axial load to the flow tube profile via the lockout tool to move the flow tube profile to the second position. Element 16: wherein applying the axial load comprises applying a downward jarring impact force on the flow tube profile via the lockout tool and thereby shearing one or more shearable devices that couple the flow tube profile to the housing, and pressurizing the tubing string uphole from the lockout tool and thereby moving the flow tube profile to the second position. Element 17: wherein moving the flow tube profile from the first position to the second position comprises shearing a first shear plug arranged in the control line bypass bore with the control line bypass piston and thereby exposing an interior control line port that places the control line bypass bore in fluid communication with the flow passage, and shearing a second shear plug arranged in the balance line bypass bore with the balance line bypass piston and thereby exposing an exterior balance line port that places the balance line bypass bore in fluid communication with the balance line jumper conduit. Element 18: further comprising positioning a wireline retrievable safety valve within the bypass diverter sub, receiving the control line pressure diverted into the flow passage with the wireline retrievable safety valve, and receiving the balance line pressure diverted into the balance line jumper at a balance chamber defined in the wireline retrievable safety valve and communicably coupled to the balance line jumper conduit.

By way of non-limiting example, exemplary combinations applicable to A, B, and C include: Element 5 with Element 6; Element 5 with Element 7; Element 12 with Element 13; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A bypass diverter sub, comprising:

a housing defining a flow passage;

a control line bypass piston movably arranged within a control line bypass bore defined in a wall of the housing;

a balance line bypass piston movably arranged within a balance line bypass bore defined in the wall of the housing;

an outer magnet movably disposed within an magnet chamber defined in the wall of the housing, the outer magnet being operatively coupled to the control and balance line bypass pistons such that axial movement of the outer magnet correspondingly moves the control and balance line bypass pistons; and a flow tube profile positioned within the flow passage and providing an inner magnet magnetically coupled to the outer magnet such that movement of the flow tube profile correspondingly moves the control and balance line bypass pistons, wherein the flow tube profile is movable between a first position, where control line pressure circulates through the control line bypass bore and the magnet chamber, and balance line pressure circulates through the balance line bypass bore, to a second position, where the control line pressure is diverted into the flow passage and the balance line pressure is diverted into a balance line jumper conduit.

2. The bypass diverter sub of claim 1, further comprising:

a first dynamic seal movable with the control line bypass piston within the control line bypass bore;

a second dynamic seal movable with the balance line bypass piston within the balance line bypass bore; and a third dynamic seal positioned in the balance line bypass bore to prevent fluid communication between the magnet chamber and the balance line bypass bore.

3. The bypass diverter sub of claim 1, wherein the flow tube profile further defines an inner profile that receives an outer profile of a lockout tool used to move the flow tube profile from the first position to the second position.

4. The bypass diverter sub of claim 1, further comprising one or more shearable devices that secure the flow tube profile to the housing.

5. The bypass diverter sub of claim 1, further comprising:

a first shear plug arranged in the control line bypass bore and shearable by the control line bypass piston when the flow tube profile moves to the second position, whereby an interior control line port becomes exposed and places the control line bypass bore in fluid communication with the flow passage; and a second shear plug arranged in the balance line bypass bore and shearable by the balance line bypass piston when the flow tube profile moves to the second position, whereby an exterior balance line port becomes exposed and places the balance line bypass bore in fluid communication with a balance line jumper conduit.

6. The bypass diverter sub of claim 1, further comprising a locking mechanism that secures the outer magnet and the control and balance line bypass pistons in position after the flow tube profile moves to the second position.

7. The bypass diverter sub of claim 6, wherein the locking mechanism comprises:

a series of first angled teeth defined on the outer magnet; and a series of second angled teeth defined on a wall of the magnet chamber, wherein the series of first and second angled teeth are angled such that the outer magnet is able to ratchet over the second series of angled teeth as the outer magnet moves in a first direction, but prevent the outer magnet from moving in a second direction opposite the first direction.

8. The bypass diverter sub of claim 6, wherein the locking mechanism comprises:

a collet arranged in the magnet chamber including one or more axially extending collet fingers; and an external fish neck defined on an end of the outer magnet and configured to be received by the collet fingers.

9. A well system, comprising:

a tubing string extendable within a wellbore;

a subsurface safety valve interconnected with the tubing string;

a bypass diverter sub interconnected with the tubing string and operatively coupled to the subsurface safety valve;

a control line providing control line pressure to the bypass diverter sub;

a balance line providing balance line pressure to the bypass diverter sub, wherein the bypass diverter sub comprises:

a housing having a first end operatively coupled to the tubing string, a second end operatively coupled to the subsurface safety valve, and a flow passage that extends at least partially between the first and second ends;

a control line bypass piston movably arranged within a control line bypass bore defined in a wall of the housing and in fluid communication with the control line;

a balance line bypass piston movably arranged within a balance line bypass bore defined in the wall of the housing and in fluid communication with the balance line;

an outer magnet movably disposed within an magnet chamber defined in the wall of the housing, the outer magnet being operatively coupled to the control and balance line bypass pistons such that axial movement of the outer magnet correspondingly moves the control and balance line bypass pistons; and a flow tube profile positioned within the flow passage and providing an inner magnet magnetically coupled to the outer magnet such that movement of the flow tube profile correspondingly moves the control and balance line bypass pistons, and wherein the flow tube profile is movable between a first position, where the control line pressure circulates through the control line bypass bore, the magnet chamber, and to the subsurface safety valve, and the balance line pressure circulates through the balance line bypass bore and to the subsurface safety valve, to a second position, where the control line pressure is diverted into the flow passage and the balance line pressure is diverted into a balance line jumper conduit.

10. The well system of claim 9, further comprising:

a first shear plug arranged in the control line bypass bore and shearable by the control line bypass piston when the flow tube profile moves to the second position, whereby an interior control line port becomes exposed and places the control line bypass bore in fluid communication with the flow passage; and a second shear plug arranged in the balance line bypass bore and shearable by the balance line bypass piston when the flow tube profile moves to the second position, whereby an exterior balance line port becomes exposed and places the balance line bypass bore in fluid communication with a balance line jumper conduit.

11. The well system of claim 9, further comprising a locking mechanism that secures the outer magnet and the control and balance line bypass pistons in position after the flow tube profile moves to the second position.

12. The well system of claim 9, further comprising a wireline retrievable safety valve positionable within the bypass diverter sub, wherein the wireline retrievable safety valve receives the control line pressure diverted into the flow passage, and wherein the wireline retrievable safety valve provides a balance chamber communicably coupled to the balance line jumper conduit for receiving the balance line pressure diverted into the balance line jumper conduit.

13. A method, comprising:

conveying control line pressure to a bypass diverter sub interconnected with a tubing string extended within a wellbore, the bypass diverter sub providing a housing that defines a flow passage;

receiving the control line pressure at a control line bypass bore defined in a wall of the housing and directing the control line pressure to a subsurface safety valve interconnected with the tubing string via a magnet chamber defined in the wall of the housing;

conveying balance line pressure to the bypass diverter sub;

receiving the balance line pressure at a balance line bypass bore defined in a wall of the housing and directing the balance line pressure to the subsurface safety valve via the balance line bypass bore; and moving a flow tube profile positioned within the flow passage from a first position, where the control line pressure and the balance line pressure circulate to the subsurface safety valve, and to a second position, where the control line pressure is diverted into the flow passage and the balance line pressure is diverted into a balance line jumper conduit.

14. The method of claim 13, wherein the bypass diverter sub further includes a control line bypass piston movably arranged within the control line bypass bore, a balance line bypass piston movably arranged within the balance line bypass bore, wherein moving a flow tube profile positioned within the flow passage further comprises:

moving an inner magnet coupled to the flow tube profile;

moving an outer magnet movably disposed within the magnet chamber and magnetically coupled to the inner magnet, wherein the outer magnet is operatively coupled to the control and balance line bypass pistons; and moving the control and balance line bypass pistons as the outer and inner magnets move.

15. The method of claim 14, further comprising securing the outer magnet and the control and balance line bypass pistons in position with a locking mechanism after the flow tube profile moves to the second position.

16. The method of claim 14, wherein, when the flow tube profile is in the second position, the method further comprises:

preventing the control line pressure from reaching the subsurface safety valve with a first dynamic seal movable with the control line bypass piston within the control line bypass bore;

preventing the balance line pressure from reaching the subsurface safety valve with a second dynamic seal movable with the balance line bypass piston within the balance line bypass bore; and preventing fluid communication between the magnet chamber and the balance line bypass bore with a third dynamic seal positioned in the balance line bypass bore.

17. The method of claim 13, wherein the flow tube profile further defines an inner profile and moving the flow tube profile from the first position to the second position comprises:

conveying a lockout tool having an outer profile to the bypass diverter sub;

coupling the lockout tool to the flow tube profile by mating the inner and outer profiles; and applying an axial load to the flow tube profile via the lockout tool to move the flow tube profile to the second position.

18. The method of claim 17, wherein applying the axial load comprises:

applying a downward jarring impact force on the flow tube profile via the lockout tool and thereby shearing one or more shearable devices that couple the flow tube profile to the housing; and pressurizing the tubing string uphole from the lockout tool and thereby moving the flow tube profile to the second position.

19. The method of claim 13, wherein moving the flow tube profile from the first position to the second position comprises:

shearing a first shear plug arranged in the control line bypass bore with the control line bypass piston and thereby exposing an interior control line port that places the control line bypass bore in fluid communication with the flow passage; and shearing a second shear plug arranged in the balance line bypass bore with the balance line bypass piston and thereby exposing an exterior balance line port that places the balance line bypass bore in fluid communication with the balance line jumper conduit.

20. The method of claim 13, further comprising:

positioning a wireline retrievable safety valve within the bypass diverter sub;

receiving the control line pressure diverted into the flow passage with the wireline retrievable safety valve; and receiving the balance line pressure diverted into the balance line jumper conduit at a balance chamber defined in the wireline retrievable safety valve and communicably coupled to the balance line jumper conduit.

* * * * *